United States Patent [19]

Weingartner

[11] 4,392,699

[45] Jul. 12, 1983

[54] ELECTRICAL CONNECTOR

[75] Inventor: Bernhard Weingartner, Feldkirch, Austria

[73] Assignee: Neutrik Aktiengesellschaft, Liechtenstein

[21] Appl. No.: 243,660

[22] Filed: Mar. 13, 1981

[30] Foreign Application Priority Data

Mar. 19, 1980 [AT] Austria ..... 1496/80

[51] Int. Cl.[3] ..... H01R 13/652

[52] U.S. Cl. ..... 339/14 P; 339/136 R; 339/196 M

[58] Field of Search ..... 339/75 R, 75 M, 125 R, 339/126 R, 127 R, 127 C, 136 R, 196 R, 196 A, 196 M, 206 P, 14 P

[56] References Cited

U.S. PATENT DOCUMENTS

| | | | |
|---|---|---|---|
| 2,652,549 | 9/1953 | Ingalls et al. | 339/196 M |
| 3,885,849 | 5/1975 | Bailey et al. | 339/136 R |
| 4,302,066 | 11/1981 | Newman et al. | 339/75 R |
| 4,312,553 | 1/1982 | Lyckesjo | 339/136 R |

FOREIGN PATENT DOCUMENTS

| | | | |
|---|---|---|---|
| 2458254 | 6/1976 | Fed. Rep. of Germany | 339/196 M |
| 2717354 | 11/1978 | Fed. Rep. of Germany | 339/196 R |
| 488554 | 7/1938 | United Kingdom . | |
| 546061 | 6/1942 | United Kingdom . | |
| 853052 | 11/1960 | United Kingdom . | |
| 1050889 | 12/1966 | United Kingdom . | |
| 1567163 | 5/1980 | United Kingdom . | |
| 1584619 | 2/1981 | United Kingdom . | |

*Primary Examiner*—John McQuade

*Attorney, Agent, or Firm*—Toren, McGeady and Stanger

[57] ABSTRACT

An electrical connector assembly particularly adapted for attachment to the chassis of an appliance including a housing defining a generally longitudinal axis and an insertion piece having therein electrical contact elements for effecting desired electrical connection, the insertion piece being received within the housing from one end thereof. A flange on one end of the insertion piece engages the housing to act as a stop member when the insertion piece is placed within the housing and a slotted recess extending transversely to the longitudinal axis defined in the insertion piece a distance from the flange receives a locking lug pivotally mounted within the recess. A bore extending through the insertion piece into cooperative relationship with the locking lug enables a tool to be inserted therein to pivot the locking lug between a locking position to effect locking engagement between the insertion piece and the housing and a nonlocking position releasing this locking engagement. A shoulder defined on the interior of the housing and spaced from the one end thereof an interval corresponding to the distance between the slotted recess and the flange is engaged by the locking lug when it is in the locking position.

11 Claims, 9 Drawing Figures

ELECTRICAL CONNECTOR

The present invention relates generally to electrical plug connectors and, in particular, to a connector having a casing which is preferably attachable to the chassis of an appliance and including an insertion piece received by the casing and consisting essentially of electrically insulating material within which contact-making plugs and/or sockets are arranged.

Connectors of the type to which the present invention relates serve as chassis plugs or fixed connectors and, as their name indicates, they are mounted onto the chassis of an electrical appliance or other similar device. In connectors of this type, the insertion piece within which the contact-making plugs and/or sockets are assembled is normally fixed in the casing of the connector by attachment screws which extend perpendicularly to the axis of the contact-making plug and/or socket. An attachment arrangement of this type usually makes installation difficult since it is required that access to the connector from the side thereof be provided which is not usually possible.

In particular, a cord plug is known from German Auslegeschrift No. 27 17 354 having a one-part outer casing and an insertion piece that can be pushed into the casing in the axial direction and to which there are attached plug prongs, safety contact bridge pieces and a traction-relief mechanism for a cable. The insertion piece has a transverse bore with steps within which there rests a turnable or rotatable locking pin. The locking pin and the aforementioned bore have ramps which are functionally interrelated and which cause the locking pin when it is rotated to additionally be moved in the axial direction between a locking and a nonlocking position. In the nonlocking position, the locking pin does not protrude beyond the outer cross-sectional contour of the insertion piece so that the insertion piece may be pushed into the plug casing from the front end thereof. The plug casing is provided with an opening in axial alignment with the locking pin of the insertion piece. If a tool is introduced into this opening, rotation of the locking pin may be effected and the locking pin emerges from the insertion piece with its head or end part entering into the aforementioned opening in the casing whereby the casing and the insertion piece are locked together.

This locking approach in a cord plug of this type essentially corresponds to that previously mentioned with regard to known chassis plugs and for the reasons previously discussed, they have not been found effective even though, as a rule, accessibility from the side poses no problem with a cord plug since such a cord plug is freely movable in conjunction with the cable to which it is attached and can be rotated and swung in all directions. This is something which is not the case with a chassis plug which is mounted onto electrical appliances and devices and usually under very restricted conditions of space. If the locking system of this known plug were to be transferred to the chassis plugs or fixed connectors, then problems which would arise would be difficult to solve.

Thus, the present invention is directed toward provision of a connector which features ease of assembly even under restricted conditions of space.

SUMMARY OF THE INVENTION

Briefly, the present invention may be described as an electrical connector assembly particularly adapted for attachment to the chassis of an appliance comprising a housing defining a generally longitudinal axis, an insertion piece having therein electrical contact means for effecting desired electrical connections, said insertion piece being received within said housing from one end thereof, flange means on one end of said insertion piece adapted to engage said housing to act as a stop member when said insertion piece is placed within said housing, a slotted recess extending transversely to said longitudinal axis defined in said insertion piece at a distance from said flange means, a locking lug pivotally mounted within said recess, a bore extending through said insertion piece into cooperative relationship with said locking lug to enable a tool to be inserted therein for engagement with said locking lug, engagement means on said locking lug adapted to enable said tool to engage said locking lug to pivot said locking between a locking lug position to effect locking engagement between said insertion piece and said housing and an unlocking position releasing said locking engagement, and shoulder means defined on the interior of said housing and spaced from said one end thereof an interval corresponding to the distance between said slotted recess and said flange means adapted to be engaged by said locking lug when said locking lug is in said locking position.

In accordance with the invention, the ease of assembly even under the most restricted conditions of space may be achieved in that the insertion piece can be inserted from the back side of the sleeve-like housing or casing member. The insertion piece is formed with the flange means which acts as a stop at the rearward end thereof. The slotted recess is formed at a predetermined axial spacing from the flange means or collar and the locking lug or member is pivotally mounted within the recess and intersects the bore in the insertion piece which extends parallel to the axis of the assembly. The engagement means in the locking lug are preferably formed as a polygonal cutout in order to effect locking engagement between the locking lug and a rotating tool. The sleeve-like casing has on the inside thereof a stop member in the form of the shoulder means arranged at an interval from the rear edge of the housing and since this spacing corresponds to the interval between the flange means and the slotted recess, the shoulder means are arranged in operative relationship to the locking lug so that the locking lug may rest against the shoulder means to effect the locking engagement between the insertion piece and the housing.

As a result of the arrangement of the invention, it is possible not only to introduce the insertion piece into the casing or housing from the rear thereof, which is an important criterion for assembly, but it is further possible to affix the insertion piece in the housing with the assistance of a tool that it introduced in the direction of the axis of the connector. Furthermore, the insertion piece may be preassembled onto printed circuits as can other structural parts, an achievement which was not possible with prior cumbersome housings. The housing can, in turn, be premounted or preassembled on a chassis.

In accordance with a further proposal of the invention, additional advantages arise in that the slot-like opening within which the locking lug is received is formed with a configuration widened in the direction of the axis of the insertion piece beyond the portion thereof which receives the locking lug, said widened configuration comprising a portion which receives the bent fastening flange of a leaf contact spring whose main body extends essentially in the longitudinal direction of the connector, whereby the locking lug and the bent fastening flange of the contact spring are in contact and the locking member and the fastening flange are preferably equipped with indentations in the form of, for example, corrugations and projections which fix the locking member in its end positions. In this way, the contact spring, the housing, and the locking lug or member, the first two of which are as a rule connected to ground, are in electrical contact with each other by virtue of the structure involved without requiring additional means for connection. The provision for indentations constitutes a further facilitation of the assembly procedures since the placement of the parts may be audibly heard or may be felt so that an operator will have control over the respective positioning of the elements particularly the locking lug during assembly since the locking lug is not visible during this time.

According to a further feature of the invention, a holding pin extends through the locking member and through the bent or cambered fastening flange, the axis of the pin being parallel to the axis of the insertion piece, with this holding pin being received in an oblong hole extending in the direction of swivel of the locking lug. The holding pin, which serves primarily for mechanical fixing of the parts, may be constructed with a length such that it protrudes backwardly and thereby constitutes a "ground" contact lug.

In accordance with another feature of the invention, the slot-like opening is traversed, at least on the side thereof of the edge, by one of the prongs and/or sockets which serve for effecting electrical connection whereby the internal and integrated inner connection of the connector is also served. In the locking member, in that part thereof which is situated internally of the assembly, i.e., the unexposed part, there is provided a sidewardly protruding projection which makes contact as it rests against the prong or the socket when the locking lug is in the locked position.

To prevent the insertion piece from rotating out of position in the housing, the insertion piece may be equipped with an outer rib, the axis of which is parallel to the axis of the assembly and which is in functional relationship to a corresponding groove on the inside of the housing. The rib on the insertion piece may extend over the full length of the insertion piece or it may extend only over the area which is also covered by the groove in the housing. The locking lug may be constructed in such a manner that, in its nonlocking position, it may be depressed with relationship to the periphery of the insertion piece or at an angle with relation to the locking position thereof. In the latter case, the housing may be provided internally with a groove which, when the insertion piece is pushed into the housing, can receive the protruding locking lug. This groove then reaches at least to the shoulder stop against which the locking lug then rests in its locking position. If on the other hand, the locking lug is constructed in such a manner that it can be depressed in relation to the cross-sectional contour of the insertion piece, for example when the locking lug is constructed in the form of an eccentric disc, then such a groove in the housing is not required. For the sake of efficiency, the opening of the bore for receiving the tool operating the locking lug will be at the front side of the insertion piece. In this manner, the insertion piece can be affixed to the housing from the front.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 2:
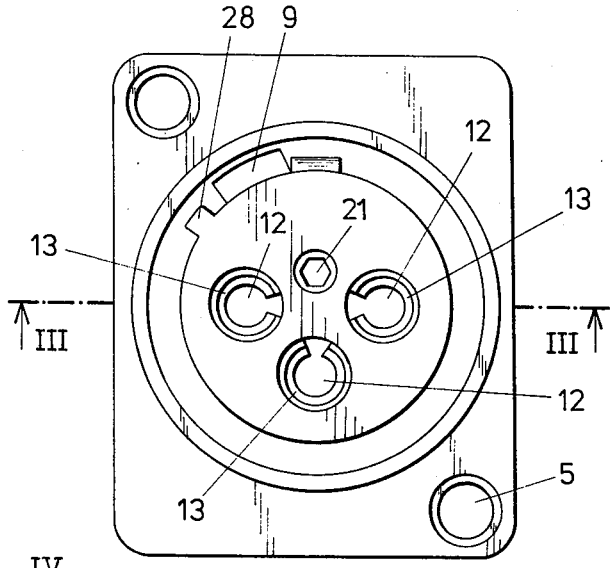
FIG. 2 shows a front view of the assembly.
Figure 1:
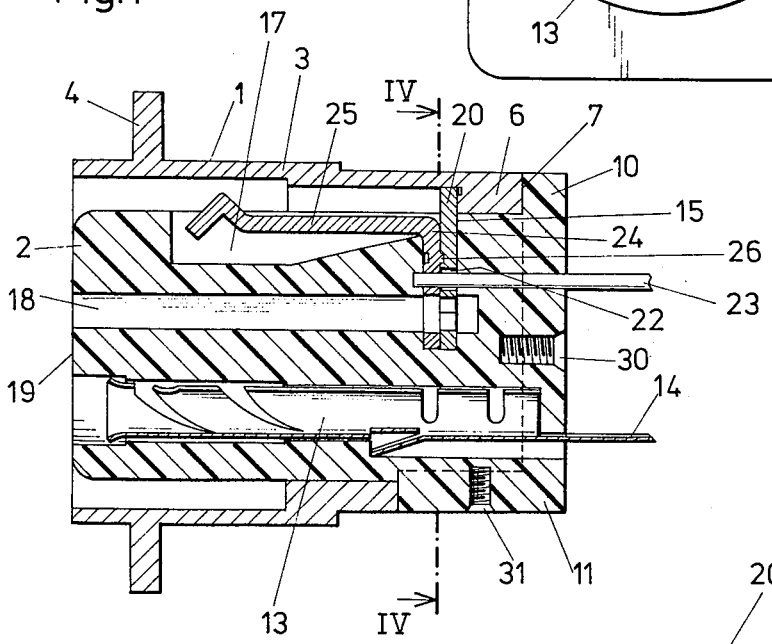
FIG. 1 is a sectional view showing a connector assembly in accordance with the invention.
Figure 3:
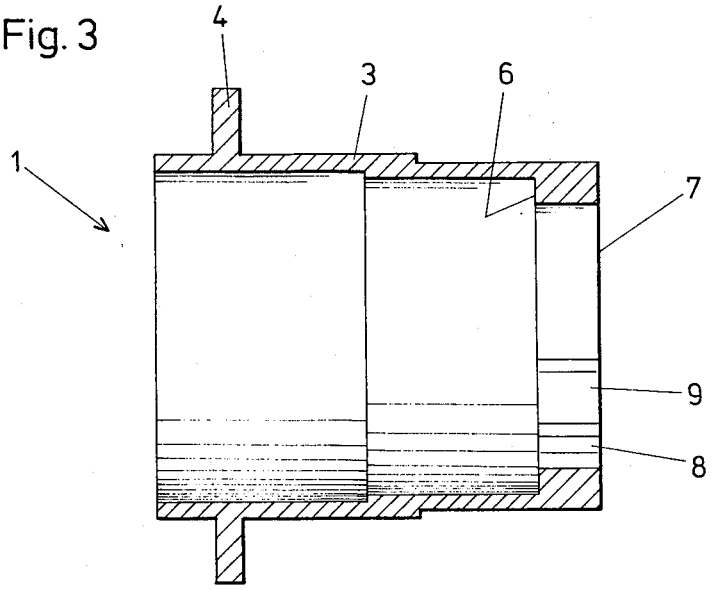
FIG. 3 is a sectional view taken along the line III—III in FIG. 2.

Referring now to the drawings, and particularly to FIG. 1, there is shown an electrical connector assembly which includes a housing or casing 1 and an insertion piece 2 which is made essentially of electrically insulating material. The housing 1 is made of a metallic material which consists of a sleeve 3 with a front-side fastening flange 4 having bores 5 for receiving fastening screws. In its rear part, the sleeve 3 has a shoulder stop 6 which is oriented inwardly. In the embodiment shown in FIG. 1, two parallel grooves 8 and 9, best seen from FIG. 3, extend from the rear edge 7 of the sleeve 3, the function of these grooves being defined more fully hereinafter. The rear side edge 7 of the sleeve 3 is equipped with steps, as will be seen from FIGS. 8 and 9.

The insertion piece 2 is shaped in the form of a cylinder. It includes a collar or flange 10 on the rear side thereof and adjacent to the flange 10, extending over only a short part of the length of the insertion piece 2, there is provided a radially projecting stop 11 which in the proper mounting or assembly position of the insertion piece is received by the aforementioned steps indicated by dotted line in FIG. 1 on the rear side of the edge 7 of the sleeve 3. Three bores 12 having parallel axes are formed in the insertion piece 2 and serve to receive therein contact sleeves 13 which protrude rearwardly with rear contact lugs 14.

Figure 5:
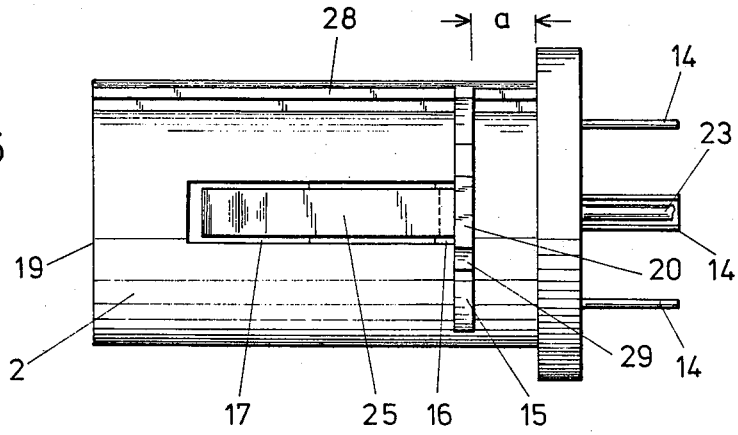
FIG. 5 is a top view of the insertion piece shown withdrawn from the housing.

At a distance a, best seen in FIG. 5, from the collar or flange 10, there is provided in the insertion piece 2 a slotted recess or opening 15 which extends transversely to the longitudinal axis of the connector assembly and which includes a widening configuration 16 extending forwardly and leading into a trough or channel 17 in the insertion piece. This trough or channel 17 runs in a direction parallel to the longitudinal axis of the assembly.

Near the center of the insertion piece 2 there is further provided a bore 18 extending in a direction parallel to the axis and commencing from the front end face 19, the bore 18 penetrating into the slot-like cutout or recess 15. The recess 15 is dimensioned in such a way that at least one of the contact sleeves 13 will intersect with the recess at its edge, as best seen from FIG. 4. In the recess 15 there rests a locking lug or plate 20 which is provided with a polygonal bore 21 arranged in alignment with the bore 18. Above the polygonal bore 21 there is formed an arcuate slot 22 with a holding pin 23 extending parallel to the longitudinal axis of the assembly extending through the slot 22.

Figure 4:
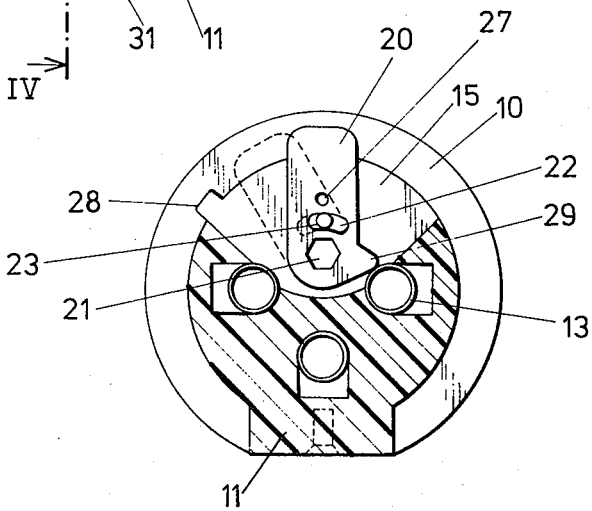
FIG. 4 is a sectional view taken along the line IV—IV of FIG. 1.

The holding pin 23 also grips a bent or cambered fastening flange 24 of a leaf spring 25 which lies in the trough or channel 17. A projection 26 on the fastening flange 24 and depressions 27 in the locking lug 20 form together a functionally interrelated system of indentations which affix the locking lug in its two end positions. These positions are shown in FIG. 4 in solid and dotted line with the locking position of the lug 20 being shown in solid line and with the nonlocking position thereof being shown in dotted line.

On the exterior surface of the insertion piece 2 and parallel to its axis, there is also provided a tongue 28 which, in conjunction with the groove 8 in the housing 1, constitutes a further protection against unwanted rotation. On a portion of the locking lug 20 located interiorly of the assembly, there is provided a projection 29, as seen in FIG. 4. Bores 30 and 31 in the insertion piece 2 serve to receive therein fastening screws whereby plates for printed circuits 32, 33 may be fastened directly to the insertion piece as best seen in FIGS. 8 and 9.

For connection to the wiring of an appliance or to a printed circuit, the insertion piece 2 is first positioned outside of the housing 1. Once the connection is made, an Allen wrench or similar tool may be introduced into the bore 18 from the front side thereof until the tool engages in the polygonal bore of the locking lug 20. Then, the locking lug 20 may be rotated into the nonlocking position. The insertion piece 2 will now be pushed into the housing 1 from the rear at which time the tongue 28 of the insertion piece 2 is received by the groove 8 and the locking lug 20 in the non-locking position is received by the groove 9 in the housing 1. When the housing 1 is pushed up to the flange 10 of the insertion piece 2, the locking lug 20 is then turned into its locking position shown in solid line particularly in FIGS. 1 and 4. The aforementioned tool or Allen wrench is utilized to rotate the locking lug 20 in such a way that the lug 20 will now rest against the shoulder stop 6 of the housing 1 and will thus be secured against axial displacement.

Figure 8:
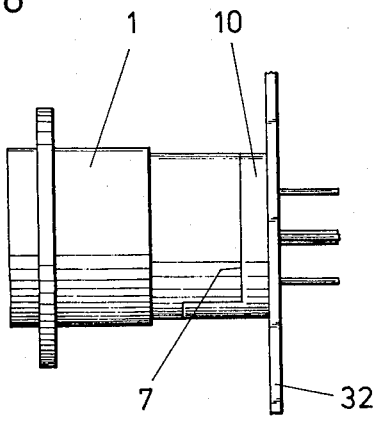
FIGS. 8 and 9 are each schematic views showing on a reduced scale side views of connector assemblies having a printed circuit plate attached thereto.
Figure 9:
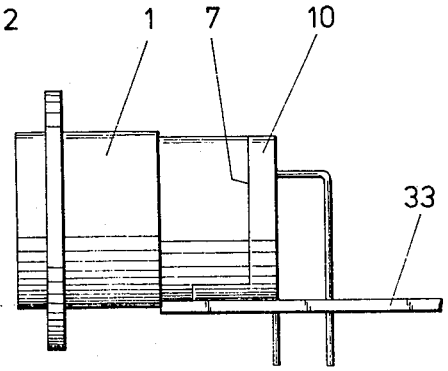

FIGS. 8 and 9 show in side view the examples whereby printed circuits 32 and 33 may be connected. For this purpose, the insertion piece 2 or the connector in its entirety is connected to the printed circuit by means of screws which are received in the bores 30 and 31, respectively, in the insertion piece 2.

Figure 7:
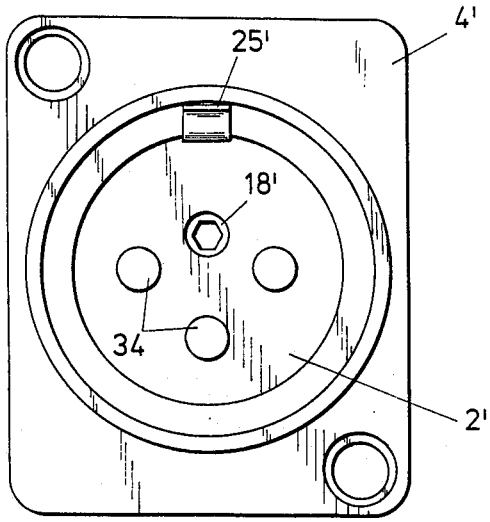
FIG. 7 is a front view of the device of FIG. 6.
Figure 6:
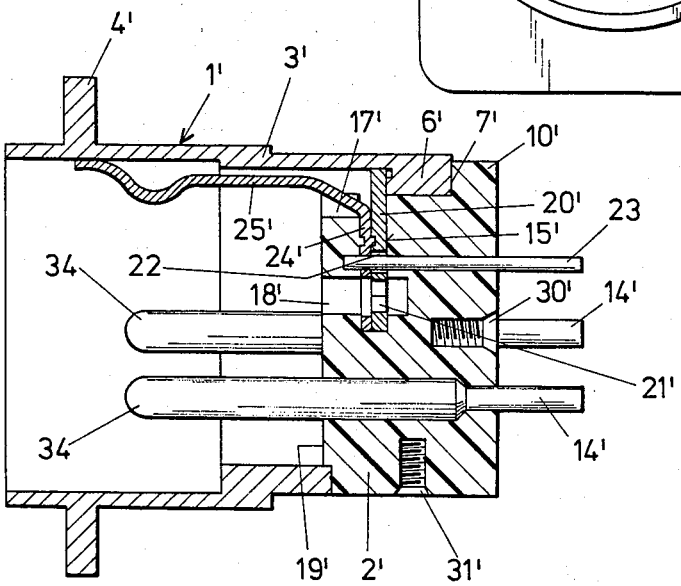
FIG. 6 is a sectional view taken through a connector assembly with contact prongs.

FIGS. 6 and 7 show a connector assembly having contact prongs 34. The basic structure of the connector assembly will be derived from the drawings and from the disclosure previously set forth herein. Similar parts are identified with similar reference numerals and for this purpose an index mark has been added to each of the reference numerals to differentiate from the embodiment previously described. The basic difference with regard to the connector assembly previously discussed and that shown in FIGS. 6 and 7 involves the fact that in the embodiment depicted in FIGS. 6 and 7, contact prongs 34 are provided, the insertion piece 2′ is shorter and the spring 25′ is formed with a somewhat different configuration.

While specific embodiments of the invention have been shown and described in detail to illustrate the application of the inventive principles, it will be understood that the invention may be embodied otherwise without departing from such principles.

What is claimed is:

1. An electrical connector assembly particularly adapted for attachment to the chassis of an appliance comprising: a housing defining a generally longitudinal axis; an insertion piece having therein electrical contact means for effecting desired electrical connection, said insertion piece being received within said housing from one end thereof; flange means on one end of said insertion piece adapted to engage said housing to act as a stop member when said insertion piece is placed within said housing; a slotted recess extending transversely to said longitudinal axis defined in said insertion piece a distance from said flange means; a locking lug pivotally mounted within said recess; a bore extending through said insertion piece into cooperative relationship with said locking lug to enable a tool to be inserted therein for engagement with said locking lug; engagement means on said locking lug adapted to enable said locking lug to be engaged by said tool to pivot said locking lug between a locking position to effect locking engagement between said insertion piece and said housing and a nonlocking position releasing said locking engagement; and shoulder means defined on the interior of said housing and spaced from said one end thereof an interval corresponding to the distance between said slotted recess and said flange means, said shoulder means being adapted to be engaged by said locking lug when said locking lug is in said locking position.

2. An assembly according to claim 1 wherein said slotted recess is formed with a configuration extending in the direction of said axis widened beyond the portion thereof occupied by said locking lug, said recess receiving in said widened configuration a bent flange of a leaf contact spring which extends essentially in the longitudinal direction of said assembly.

3. An assembly according to claim 2 wherein said locking lug and said bent flange of said contact spring bear against each other to effect electrical contact and wherein on said locking lug and on said flange there are provided indentations in the form of depressions and projections which affix the locking lug in its locking and nonlocking positions.

4. An assembly according to claim 2 or 3 further comprising a holding pin extending parallel to said axis and extending through said locking lug and said bent flange, said holding pin being received in an oblong hole extending in the pivoting direction of said locking lug.

5. An assembly according to claim 1 wherein said slotted recess is intersected at least at its edge by said electrical contact means and wherein said locking lug on a part thereof interiorly of said assembly is formed with a sideward projection which is in electrical contact with said electrical contact means in the locked position of said locking lug.

6. An assembly according to claim 1 wherein said insertion piece is formed with an outer rib extending parallel to said axis and wherein said rib serves as a protection against rotation of said insertion piece relative to said housing, said rib being arranged in cooperative relationship with a corresponding groove on the interior of said housing.

7. An assembly according to claim 1 wherein a groove is provided extending from the rear edge of said housing parallel to said axis for receiving said locking lug in its nonlocking position during insertion of said insertion piece, said groove extending at least to said shoulder means of said housing.

8. An assembly according to claim 1 wherein said shoulder means is formed by a groove extending around the inside of said housing.

9. An assembly according to claim 1 wherein said locking lug is constructed as a rectangular lug.

10. An assembly according to claim 1 wherein said bore for receiving said tool opens to the front side of said insertion piece.

11. An assembly according to claim 1 wherein said locking lug in its nonlocking position is located to extend at an angle with relation to its locking position.

* * * * *